US011242621B2

(12) United States Patent
Yu et al.

(10) Patent No.: US 11,242,621 B2
(45) Date of Patent: Feb. 8, 2022

(54) ADHESIVE THREAD DRAWING PROCESSES

(71) Applicant: WINN APPLIED MATERIAL, INC., Changhua County (TW)

(72) Inventors: Chung-Ming Yu, Changhua County (TW); Shi-Wei Wang, Changhua County (TW); Shih-Hao Wang, Changhua County (TW)

(73) Assignee: WINN APPLIED MATERIAL INC., Changhua County (TW)

( * ) Notice: Subject to any disclaimer, the term of this patent is extended or adjusted under 35 U.S.C. 154(b) by 260 days.

(21) Appl. No.: 16/564,134

(22) Filed: Sep. 9, 2019

(65) Prior Publication Data

US 2020/0173056 A1 Jun. 4, 2020

(30) Foreign Application Priority Data

Nov. 30, 2018 (TW) ..... 107143083

(51) Int. Cl.

| | |
|---|---|
| ***D01D 5/088*** | (2006.01) |
| ***D01D 5/12*** | (2006.01) |
| ***D01D 7/00*** | (2006.01) |
| ***D01F 6/70*** | (2006.01) |

(52) U.S. Cl.

CPC ..... *D01D 5/088* (2013.01); *D01D 5/12* (2013.01); *D01D 7/00* (2013.01); *D01F 6/70* (2013.01)

(58) Field of Classification Search

CPC ..... B29C 48/05; D01D 1/04; D01D 10/02; D01D 10/0436; D01D 10/06; D01D 5/08; D01D 5/16

See application file for complete search history.

(56) References Cited

U.S. PATENT DOCUMENTS 3,259,681 A * 7/1966 Bull ..... D02J 1/223 264/177.13
3,279,225 A * 10/1966 Knudsen ..... D01D 10/0436 68/181 R
3,285,592 A * 11/1966 Ueda ..... C08J 3/00 432/13
3,513,110 A * 5/1970 Noether ..... D01D 5/247 521/182
3,691,748 A * 9/1972 Buzano ..... D01D 5/20 428/369
3,725,523 A * 4/1973 Bowen ..... D06B 3/04 264/289.6

(Continued)

OTHER PUBLICATIONS

"High Strength Polyester Thread for Sewing", Ningbo MH, 5 pages, https://www.mhthread.com/100d-3-100-polyester-high-tenacity-sewing-thread (Year: 2021).*

*Primary Examiner* — Xiao S Zhao
*Assistant Examiner* — Emmanuel S Luk
(74) *Attorney, Agent, or Firm* — Guice Patents PLLC

(57) ABSTRACT

The adhesive thread drawing processes include the steps of feeding, mixing and stirring, first drying, hot melt extrusion, first cooling, stretch extension, second cooling, winding-strands-into-roll, and second drying. The threads made by the processes are woven into fabric which has a certain level of stickiness so as to be attached onto objects without using glue and adhesive, and the fabric is flat and neat when it is attached to an object.

9 Claims, 8 Drawing Sheets

(56) References Cited

U.S. PATENT DOCUMENTS 3,789,026 A * 1/1974 Baumann et al. . D01D 10/0436 521/48
4,001,367 A * 1/1977 Guthrie ..... D01D 5/16 264/154
4,116,924 A * 9/1978 Peabody ..... C08J 3/22 106/400
4,265,849 A * 5/1981 Borenstein ..... D01D 5/16 156/435
4,389,364 A * 6/1983 Endo ..... D04H 1/4391 264/167
4,476,302 A * 10/1984 Wiezer ..... C08G 18/3842 544/198
4,531,991 A * 7/1985 Ziemek ..... B29C 44/324 156/79
4,833,026 A * 5/1989 Kausch ..... C08J 7/0427 428/315.5
4,902,462 A * 2/1990 Bert ..... D01D 5/08 264/103
5,234,720 A * 8/1993 Neal ..... D01D 5/253 427/393.1
5,609,888 A * 3/1997 Uda ..... D01D 5/16 425/66
8,881,497 B2 * 11/2014 Zenzen ..... D02J 1/22 57/310
2002/0148551 A1 * 10/2002 Knauseder ..... C09J 5/00 156/182
2003/0106568 A1 * 6/2003 Keck ..... A47L 13/20 134/6
2004/0086702 A1 * 5/2004 Morin ..... D01F 6/06 428/317.9
2010/0215895 A1 * 8/2010 Nadkarni ..... D01D 5/30 428/90
2011/0203483 A1 * 8/2011 Yamada ..... C08B 3/16 106/162.72
2013/0187367 A1 * 7/2013 Kim ..... D06N 3/0068 280/743.1
2013/0236583 A1 * 9/2013 Weinhold ..... B29C 48/919 425/143
2013/0270812 A1 * 10/2013 Murakami ..... B42D 25/475 283/85
2015/0298359 A1 * 10/2015 Pitman ..... B29B 9/065 524/584
2016/0096320 A1 * 4/2016 Bourgoyne ..... B29C 48/0019 428/304.4
2018/0347074 A1 * 12/2018 Humfeld ..... D01F 9/32
2019/0048491 A1 * 2/2019 Bai ..... C08K 3/04
2019/0071796 A1 * 3/2019 Parikh ..... A61L 31/06
2020/0362475 A1 * 11/2020 Onogi ..... D01F 6/34

* cited by examiner

ADHESIVE THREAD DRAWING PROCESSES

BACKGROUND OF THE INVENTION

1. Fields of the Invention

The present invention relates to adhesive thread drawing processes, and more particularly, to the adhesive threads can be woven to fabric that includes adhesiveness so that the fabric is attached another fabric without using adherent.

2. Descriptions of Related Art

The fabric is composed of multiple threads or yarns which are woven into specific patterns to meet different needs. However, when using the fabric to an object, such as the fabric is used as the outer surface of a suitcase, the fabric still needs to be glued to the suitcase manually. The fabric is glued to the suitcase and waits for a period of time to dry. It is experienced that the glue is not evenly attached with the fabric, so that after the fabric is secured by the glue, small areas of bumps are found and affect the competitiveness in the market. Besides, the step of applying glue to the suitcase increases manufacturing cost and time.

For decoration purposes, multiple pieces of fabric are combined to form an attractive. The conventional way is to connect the multiple pieces of fabric is to glue or sew them together. Bumps and uneven surface will be obvious along the boundaries between the multiple pieces of fabric.

The present invention intends to provide adhesive thread drawing processes and the fabric composed of the threads of the processes of the present invention can easily be secured to objects while keep the surface of the objects flat and neat.

SUMMARY OF THE INVENTION

The present invention relates to thread drawing processes which comprises the following steps:

a step of feeding: preparing and inputting a plurality of thermoplastic polyurethane particles into a stirring drum and adding a coupler into the stirring drum, wherein the coupler is a mixture of resin and crosslinker;

a step of mixing and stirring: using the stirring drum to mix and stir the thermoplastic polyurethane particles and the coupler;

a step of first drying: drying the thermoplastic polyurethane particles to remove excess water by a dryer, melting the thermoplastic polyurethane particles, wherein the drying temperature of the dryer is from 100° C. to 150° C.;

a step of hot melt extrusion: extruding yarns from an outlet of the thread drawing machine, the thermoplastic polyurethane particles being melted and coated to the outer periphery of the yarn to form a preliminary thread;

a step of first cooling: passing the preliminary thread through a cooling tank so as to shape the surface of the preliminary thread;

a step of stretch extension: passing the cooled preliminary thread through a stretching area to perform a stretch extension, wherein the stretching area includes a plurality of rollers, the rollers are disposed with an interval apart from each other and arranged in rows, and the preliminary thread is driven by each roller, so that the preliminary thread is stretched;

a step of second cooling: entering the preliminary thread processed by the step of stretch extension into an cooling area which is located next to the stretching area, and the preliminary thread being cooled to reduce surface deformation and to fix the interior of the preliminary thread so as to obtain a semi-finished thread;

a step of winding-strands-into-roll: scrolling the semi-finished thread, and a step of second drying: using a dehumidifying and drying device to further reduce humidity in the semi-finished thread so as to obtain a finished thread.

The primary object of the present invention is to provide adhesive thread drawing processes and the threads made by the processes are made by thermoplastic polyurethane particles which are mixed with the coupler to provide a certain level of stickiness on the surface of the threads so that the fabric made by the threads are easily attached to objects by baking or blow baking. Therefore, the fabric made of the threads does not need extra glue or adherent to attach onto objects.

Another object of the present invention is that the fabric made of the threads of the present invention is flat and neat when being attached to objects.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
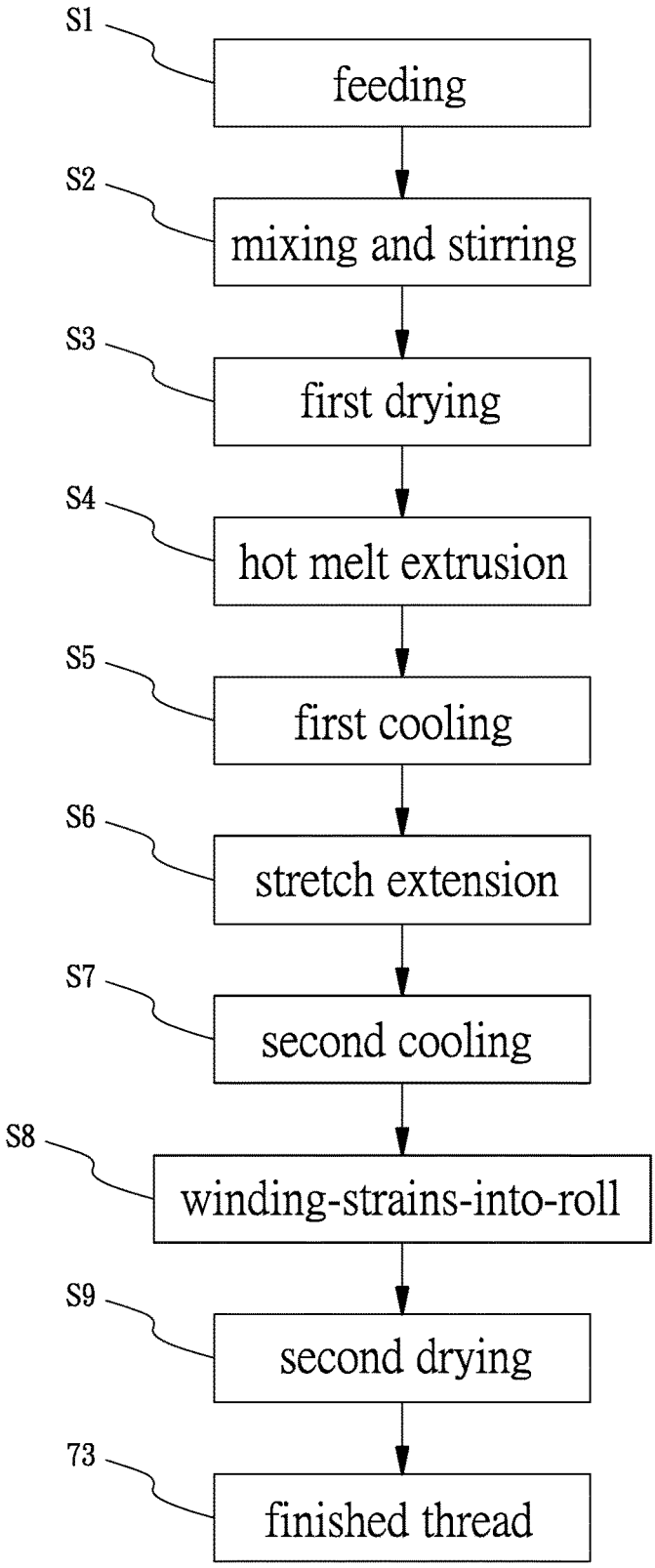
FIG. 1 shows the steps of the processes of the present invention.
Figure 2:
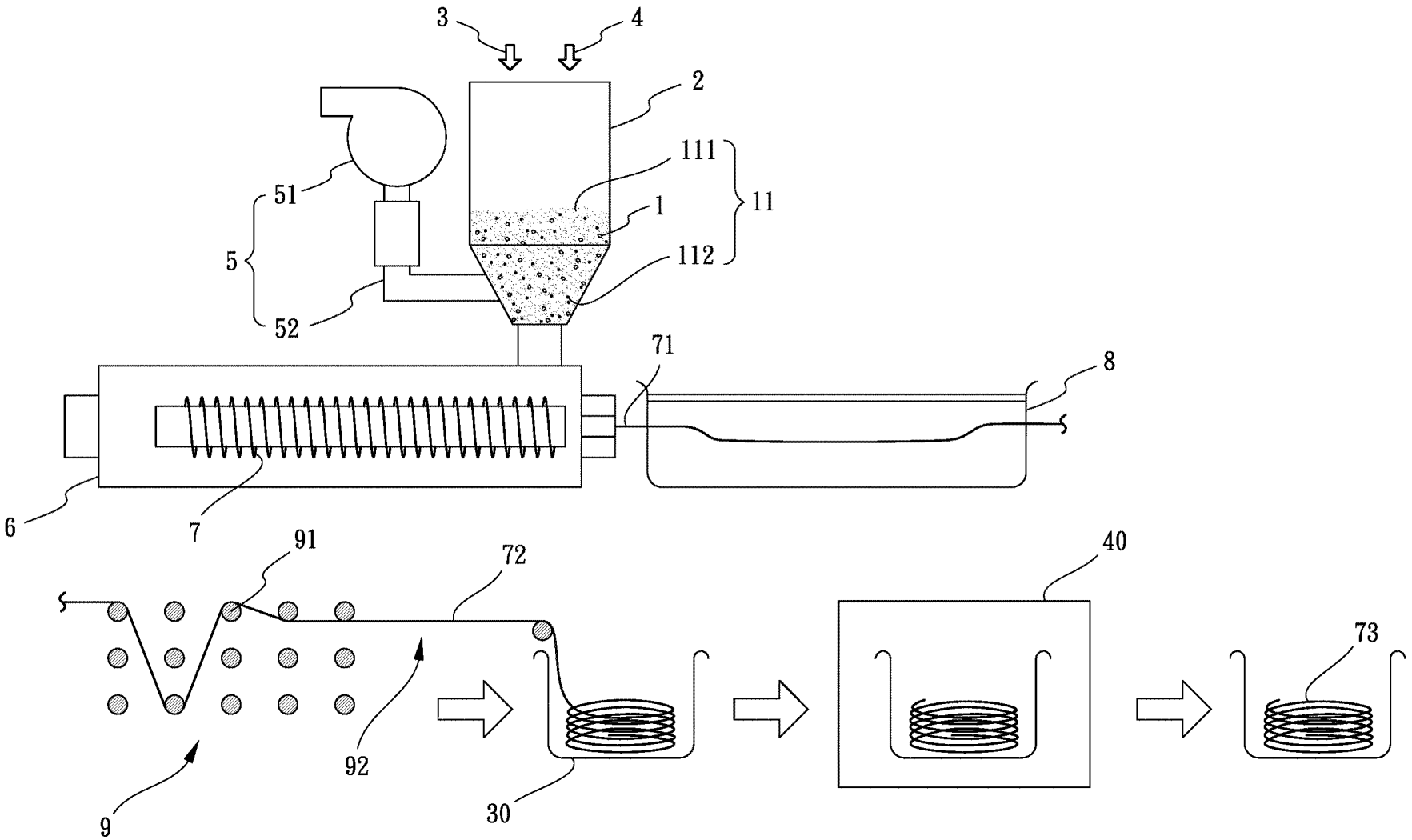
FIG. 2 illustrates the operation of the processes of the present invention.
Figure 3:
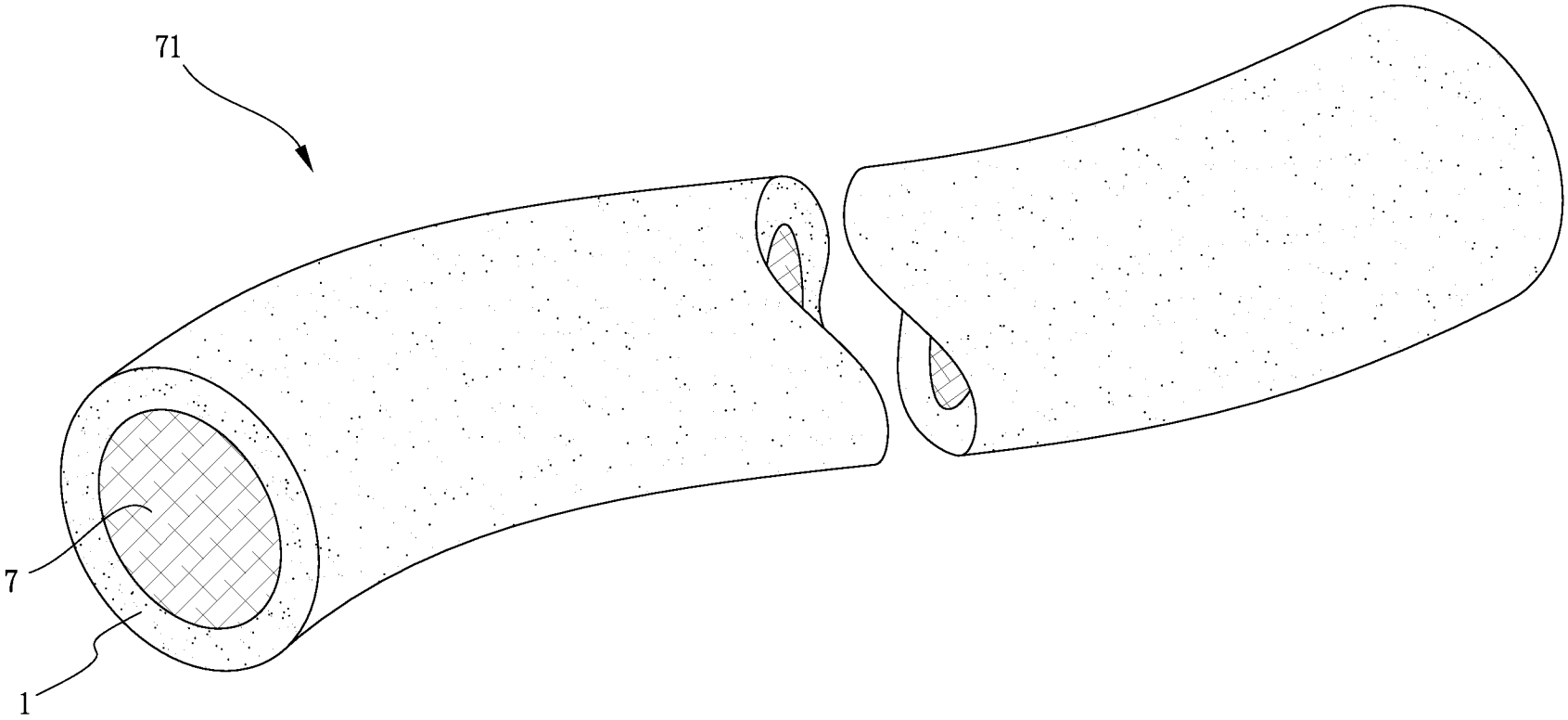
FIG. 3 shows the preliminary thread made by the processes of the present invention.
Figure 4:
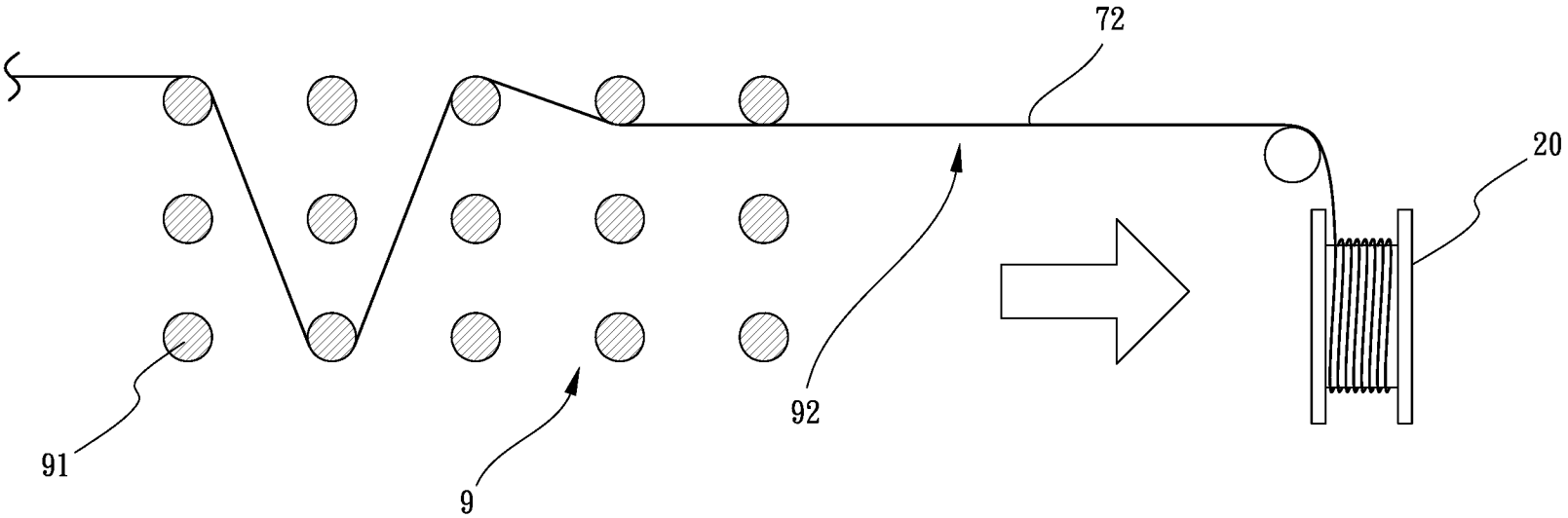
FIG. 4 shows that the semi-finished thread made by the processes of the present invention is scrolled.
Figure 5:
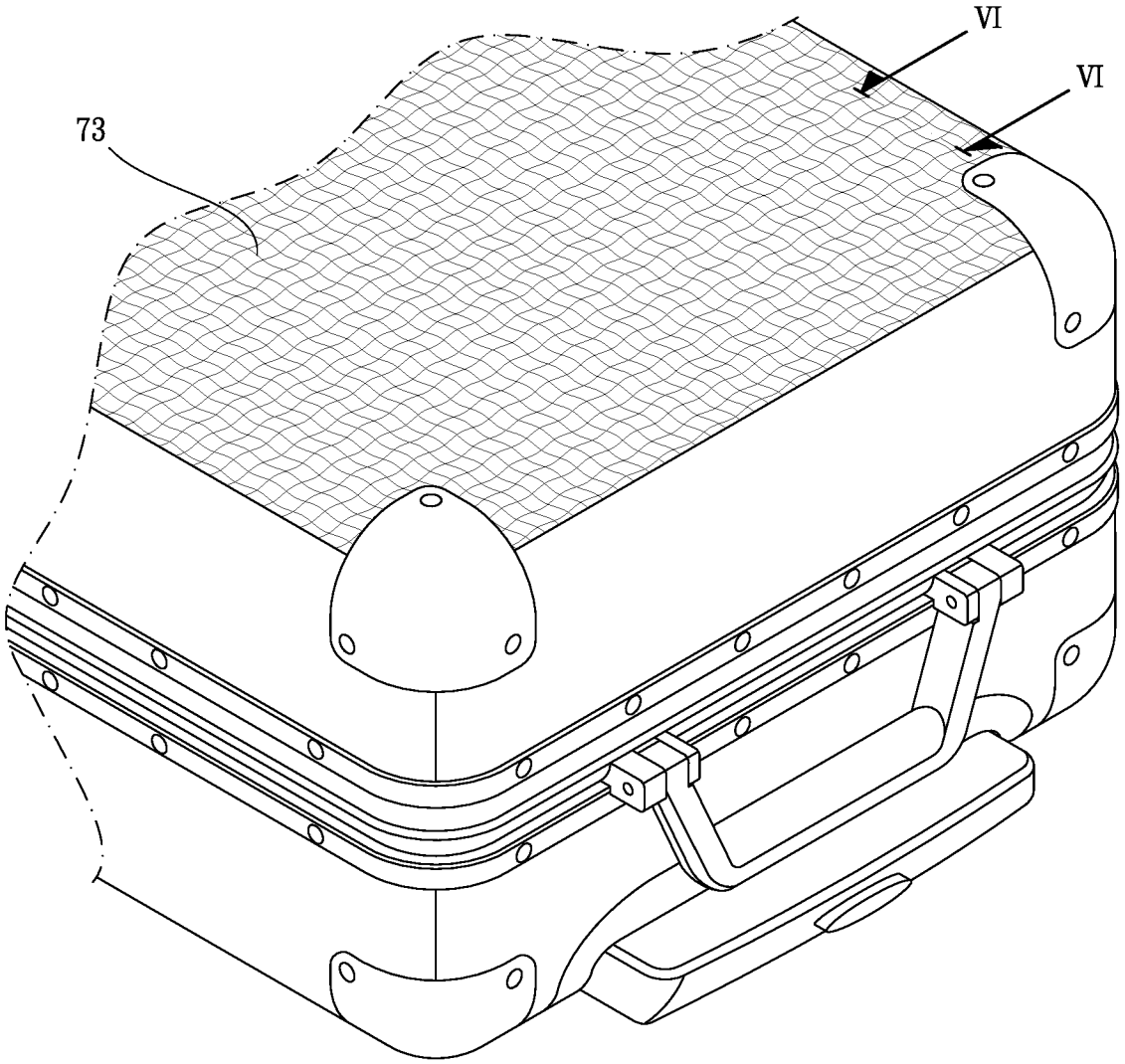
FIG. 5 shows that the fabric composed of adhesive threads made by the processes of the present invention is attached to a suitcase.

Referring to FIGS. 1 to 5, the adhesive thread drawing processes of the present invention comprises the following steps:

A step S1 of feeding: preparing and inputting a plurality of thermoplastic polyurethane particles 1 into a stirring drum 2 and adding a coupler 11 into the stirring drum 2. The coupler 11 is a mixture of resin 111 and crosslinker 112.

A step S2 of mixing and stirring: using the stirring drum 2 to mix and stir the thermoplastic polyurethane particles 1 and the coupler 11 for 3 to 5 minutes to attach the coupler 11 to the thermoplastic polyurethane particles 1. The thermoplastic polyurethane particles 1 is polyester type or polyether type, or a combination of the polyester type and the polyether type. The melting point of the plurality of the thermoplastic polyurethane particles 1 is from 190° C. to 220 so that the coupler 11 is attached to the thermoplastic polyurethane particles 1. If necessary, a brightener 3 is added in the step S2 of mixing and stirring, and the weight proportion of the brightener 3 is 0.2%~0.4% of total weight of the thermoplastic polyurethane particles 1 so that the fabric 10 composed of the adhesive threads looks clean. Alternatively, a pigment 4 with a proportion is added in the step S2 of mixing and stirring to provide desired color to the thermoplastic polyurethane particles 1 such that the fabric 10 composed of the adhesive threads have colors.

A step S3 of first drying: drying the thermoplastic polyurethane particles 1 to remove excess water by a dryer 5. And the thermoplastic polyurethane particles 1 are melted into semi-fluid status, wherein the drying temperature of the dryer 5 is from 100° C. to 150° C. and the drying time is set to be 15 to 60 minutes so as to ensure that the thermoplastic polyurethane particles 1 are melted and become semi-liquid status. The dryer 5 comprises a blower 51 and a heat pipe 52. Two ends of the heat pipe 52 respectively communicate with the blower 51 and the stirring drum 2, and the blower 51 blows hot air from the heat pipe 52 into the stirring drum 2 to dry and melt the thermoplastic polyurethane particles 1.

A step S4 of hot melt extrusion: extruding a yarn 7 in a thread drawing machine 6, wherein when the yarn 7 is drawn from the outlet of the thread drawing machine 6, and the yarn 7 is a tedron high-strength yarn. The dryer 5 is located beside the outlet so that the thermoplastic polyurethane particles 1 at the outlet are melted and coated onto the outer periphery of the yarn 7 to form a preliminary thread 71.

A step S5 of first cooling: passing the preliminary thread 71 through a cooling tank 8 in which water or cooling liquid is filled so that the thermoplastic polyurethane particles 1 coated on the thread 71 is solidified to shape the surface of the preliminary thread 71.

A step S6 of stretch extension: passing the cooled preliminary thread 71 through a stretching area 9 to perform a stretch extension, wherein the stretching area 9 includes a plurality of rollers 91, the rollers 91 are disposed with an interval apart from each other and arranged in rows, and the preliminary thread 71 is driven by each roller 91, so that the preliminary thread 71 is stretched. The shape of the cross section of the preliminary thread 71 can be controlled by the rotation speed of the rollers 91 and the tension applied to the preliminary thread 71.

A step S7 of second cooling: entering the preliminary thread 71 processed by the step of stretch extension S6 into an cooling area 92 which is located next to the stretching area 9, the preliminary thread 71 being cooled naturally such as using a fan, to reduce a surface deformation and to fix the interior of the preliminary thread 71 so as to obtain a semi-finished thread 72.

A step S8 of winding-strands-into-roll: scrolling the semi-finished thread 72. A rotary disc 20 is provided for winding the semi-finished thread 72 in the step S8 of winding-strands-into-roll, or a container 30 is placed in the cooling area 92, and then the container 30 is rotated to collect and store the semi-finished thread 72 in the step S8 of winding-strands-into-roll.

A step S9 of second drying: using a dehumidifying and drying device 40 to further reduce humidity in the semi-finished thread 72 so as to obtain a finished thread 73. The drying time is 48 hours.

Figure 6:
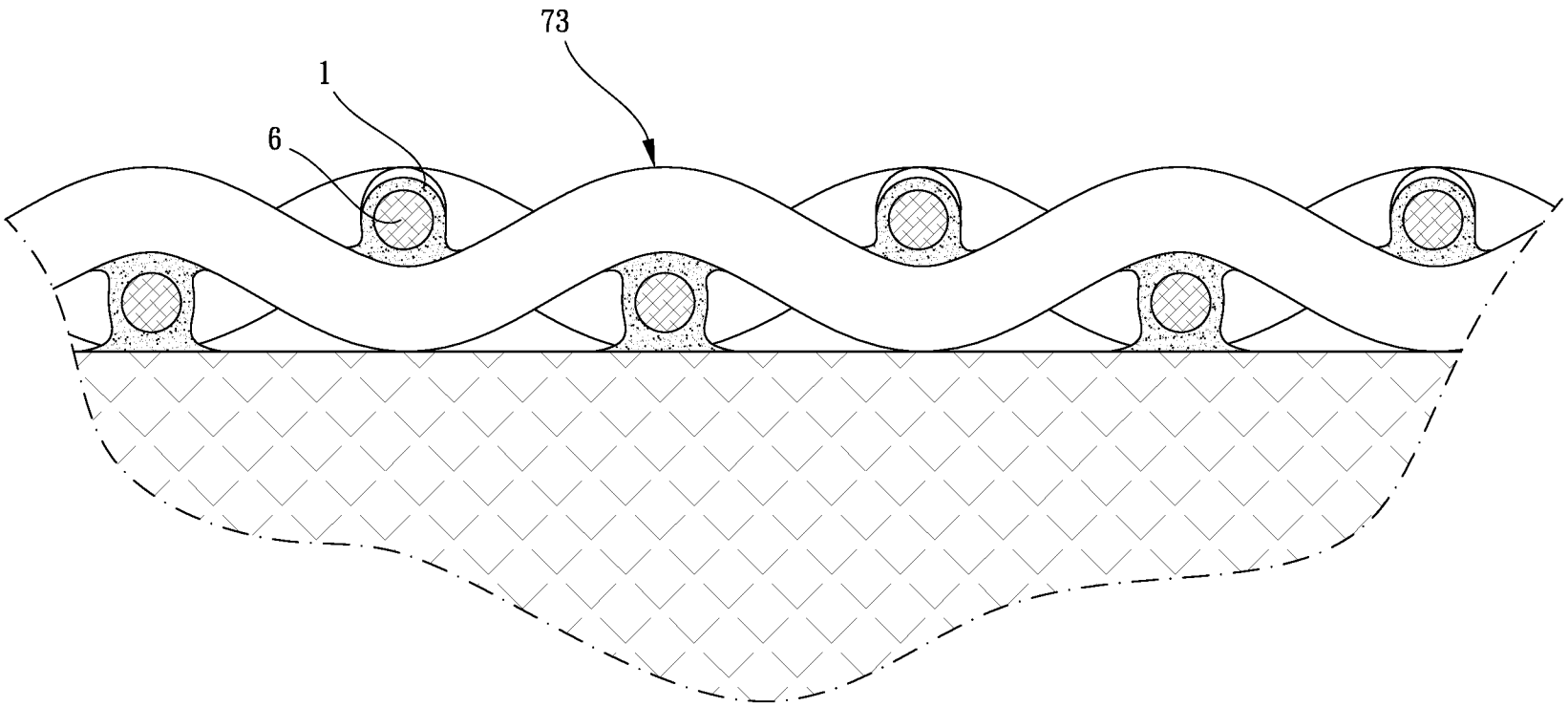
FIG. 6 is a cross sectional view, taken along line VI-VI in FIG. 5.
Figure 7:
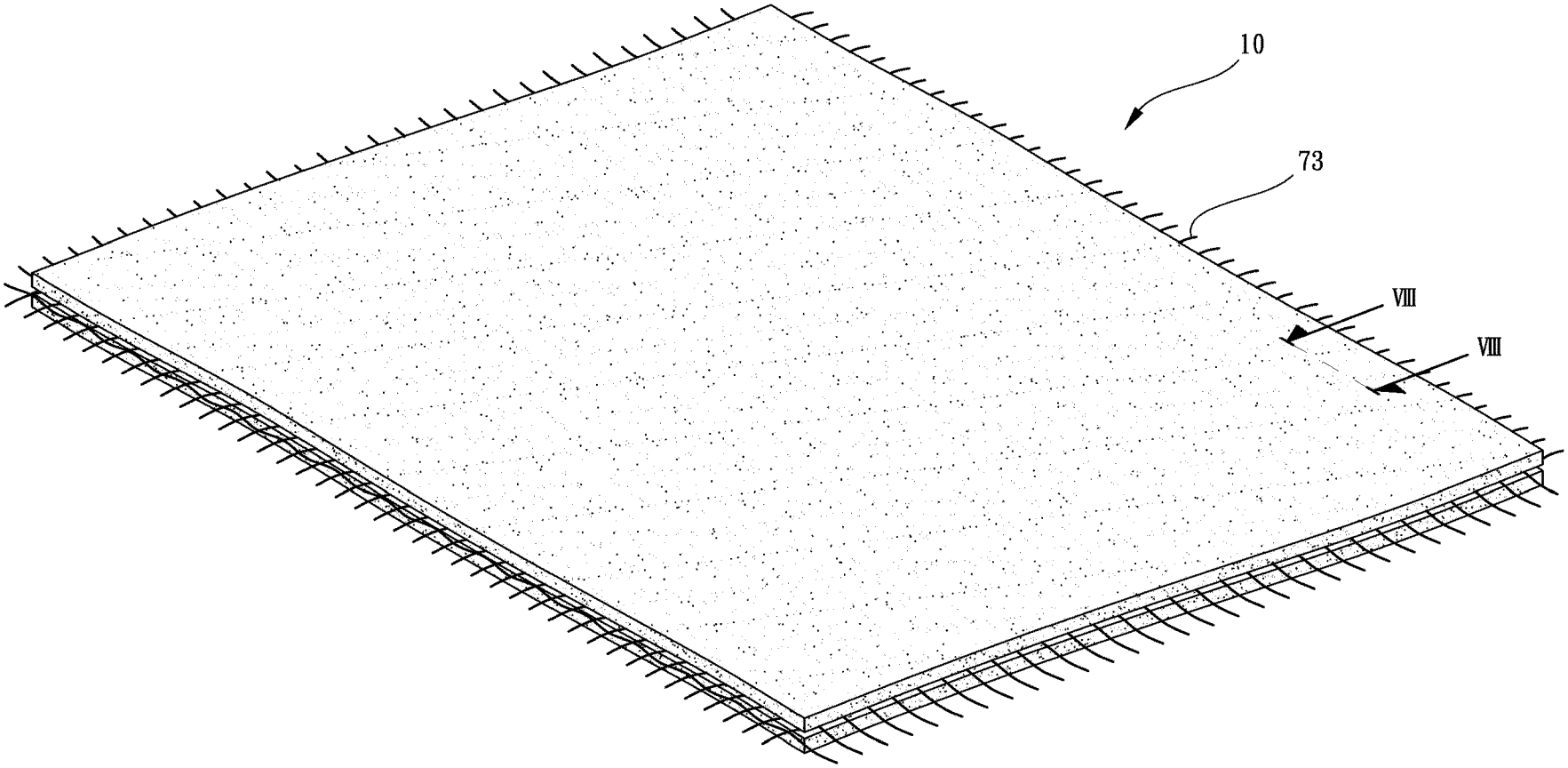
FIG. 7 shows that the piece of fabric composed of the adhesive threads made by the processes of the present invention is attached to another piece of fabric made of different material.
Figure 8:
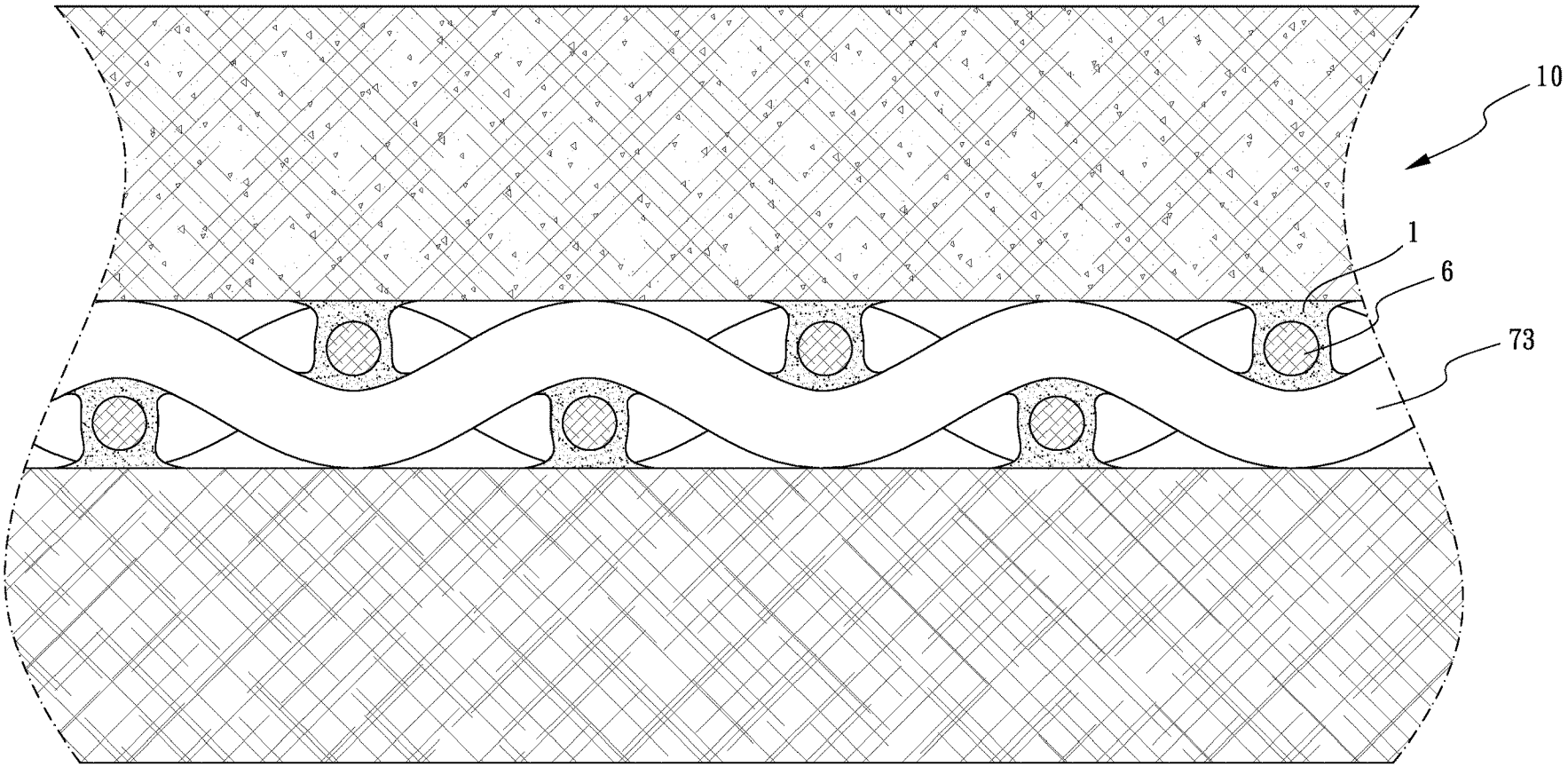
FIG. 8 is a cross sectional view, taken along line VIII-VIII in FIG. 7.

The finished threads 73 are woven to be a fabric 10. It is noted that the fabric 10 can be attached to each other without sewing or gluing, and the fabric 10 can be easily attached to objects such as the suitcase 50 disclosed in FIG. 5. Alternatively, the fabric 10 composed of the finished threads 73 is overlapped onto another piece of fabric, and the fabric 10 can be heated by any known methods to melt the thermoplastic polyurethane particles 1. The thermoplastic polyurethane particles 1 are mixed with the coupler 11 to have a certain level of stickiness so that the fabric 10 can be easily attached to another piece of fabric without using glue or adherent. Besides, the yarns 7 are a tedron high-strength yarns which are tough so as to enhance the connection when the fabric 10 is attached to an object or another piece of fabric as shown in FIGS. 6 to 8.

The fabric 10 composed of the finished threads 73 of the present invention can be attached to objects of different types of material which can be another piece of fabric, a hard case, or a plastic object. The fabric 10 is heated or baked to let the thermoplastic polyurethane particles 1 melt which is sticky and can be easily attached to ab object. The fabric 10 composed of the finished threads 73 of the present invention can also be sandwiched between two pieces of fabric.

While we have shown and described the embodiment in accordance with the present invention, it should be clear to those skilled in the art that further embodiments may be made without departing from the scope of the present invention.

What is claimed is:

1. Adhesive thread drawing processes, comprising the steps of:

a step of feeding: preparing and inputting a plurality of thermoplastic polyurethane particles into a stirring drum and adding a coupler into the stirring drum, the coupler being a mixture of resin and crosslinker;

a step of mixing and stirring: using the stirring drum to mix and stir the thermoplastic polyurethane particles and the coupler to attach the coupler to the thermoplastic polyurethane particles;

a step of first drying: drying the thermoplastic polyurethane particles to remove excess water by a dryer, a drying temperature of the dryer is from 100° C. to 150° C. to make the thermoplastic polyurethane particles in semi liquid status;

a step of hot melt extrusion: extruding a yarn from a thread drawing machine, wherein when the yarn is drawn from an outlet of the thread drawing machine, the thermoplastic polyurethane particles being melted and coated to an outer periphery of the yarn to form a preliminary thread;

a step of first cooling: passing the preliminary thread through a cooling tank so as to shape a surface of the preliminary thread;

a step of stretch extension: passing the cooled preliminary thread through a stretching area to perform a stretch extension, wherein the stretching area includes a plurality of rollers, the rollers are disposed with an interval apart from each other and arranged in rows, and the preliminary thread is driven by each roller, so that the preliminary thread is stretched;

a step of second cooling: entering the preliminary thread processed by the step of stretch extension into a cooling area which is located next to the stretching area, the preliminary thread being cooled to reduce a surface deformation and to fix an interior of the preliminary thread so as to obtain a semi-finished thread;

a step of winding-strands-into-roll: scrolling the semi-finished thread, and a step of second drying: using a dehumidifying and drying device to further reduce humidity in the semi-finished thread so as to obtain a finished thread.

2. The adhesive thread drawing processes as claimed in claim 1, wherein the thermoplastic polyurethane particles is polyester or polyether, or a combination of the polyester and the polyether, a melting point of the plurality of thermoplastic polyurethane particles is from 190° C. to 220° C.

3. The adhesive thread drawing processes as claimed in claim 2, wherein a brightener is added in the step of mixing and stirring, and a weight proportion of the brightener is 0.2%~0.4% of total weight of the thermoplastic polyurethane particles.

4. The adhesive thread drawing processes as claimed in claim 3, wherein the yarn is a tedron high-strength yarn.

5. The adhesive thread drawing processes as claimed in claim 4, wherein a pigment with a weight proportion is added in the step of mixing and stirring.

6. The adhesive thread drawing processes as claimed in claim 5, wherein a stirring time of the step of mixing and stirring is from 3 to 5 minutes.

7. The adhesive thread drawing processes as claimed in claim 6, wherein the dryer comprises a blower and a heat pipe, two ends of the heat pipe respectively communicate with the blower and the stirring drum, and the blower blows hot air from the heat pipe into the stirring drum to dry the thermoplastic polyurethane particles.

8. The adhesive thread drawing processes as claimed in claim 7, wherein a rotary disc is provided for winding the semi-finished thread in the step of winding-strands-into-roll, or a container is placed in the cooling area, and then the container is rotated to collect and store the semi-finished thread in the step of winding-strands-into-roll.

9. The adhesive thread drawing processes as claimed in claim 6, wherein the drying time of the step of first drying is from 15 to 60 minutes.

* * * * *